United States Patent [19]

Fischer

[11] 4,074,496

[45] Feb. 21, 1978

[54] COMPOSITE PLATE

[76] Inventor: Artur Fischer, Weinhalde 34, D-7244 Waldachtal 3 (Tumlingen), Germany

[21] Appl. No.: 820,129

[22] Filed: July 29, 1977

[30] Foreign Application Priority Data

Aug. 12, 1976 Germany ..... 7625293[U]

[51] Int. Cl.[2] ..... E04C 2/00; E04C 1/10

[52] U.S. Cl. ..... 52/622; 52/391; 52/506; 52/586; 52/591; 46/25; 46/31

[58] Field of Search ..... 52/622, 617, 614, 619, 52/621, 624, 582, 585, 586, 587-595, 506; 46/25, 30, 31, 26, 19, 24, 16, 17; 403/381

[56] References Cited

U.S. PATENT DOCUMENTS

| | | | |
|---|---|---|---|
| 961,992 | 6/1910 | Underwood | 46/26 X |
| 1,009,469 | 11/1911 | Burrowes | 52/585 X |
| 3,074,520 | 1/1963 | Grubelich | 46/31 |
| 3,456,413 | 7/1969 | Fischer | 52/591 |
| 3,504,470 | 4/1970 | Pincemin | 52/511 X |
| 3,510,979 | 5/1970 | Fischer | 46/25 |
| 3,597,873 | 8/1971 | Fischer | 46/16 |
| 3,902,291 | 9/1975 | Zucht | 52/586 X |
| 3,946,529 | 3/1976 | Chevaux | 52/506 X |
| 4,035,977 | 7/1977 | Fischer | 46/25 X |

*Primary Examiner*—Ernest R. Purser
*Assistant Examiner*—Robert C. Farber
*Attorney, Agent, or Firm*—Michael J. Striker

[57] ABSTRACT

A composite large plate is connected with a structural element and has an undercut coupling projection having at least two structural plates. Each of the structural plates has two undercut slots and is adapted to be located adjacent to one another so that at least one of the slots of one of the structural plates is substantially parallel to one slot of the other structural plate. A plate-like connecting member is provided, having two elongated undercut projections substantially parallel to one another and each engageable in one of the slots of the structural plates. When the elongated undercut projections engage in the slots of the structural plates the latter are assembled with one another so as to form the composite plate, and the structural element can be connected to the thus-formed composite plate by inserting the coupling projection thereof in the respective other one of the slots. Two further structural plates may be located adjacent to the two first-mentioned plate so that the slots of the latter are in alignment with the slots of the further structural plates. The elongated projections of the connecting member are of a length exceeding the length of the slots and thereby they not only connect the structural plates of each pair with one another, but also connect the both pairs of the structural plates with each other. The elongated projections of the connecting member may be of a length equal to twice the length of the slots so that two slots of the adjacent structural plates which are in alignment with one another, are overlapped by the elongated projection of the connecting member.

8 Claims, 2 Drawing Figures

FIG. 1
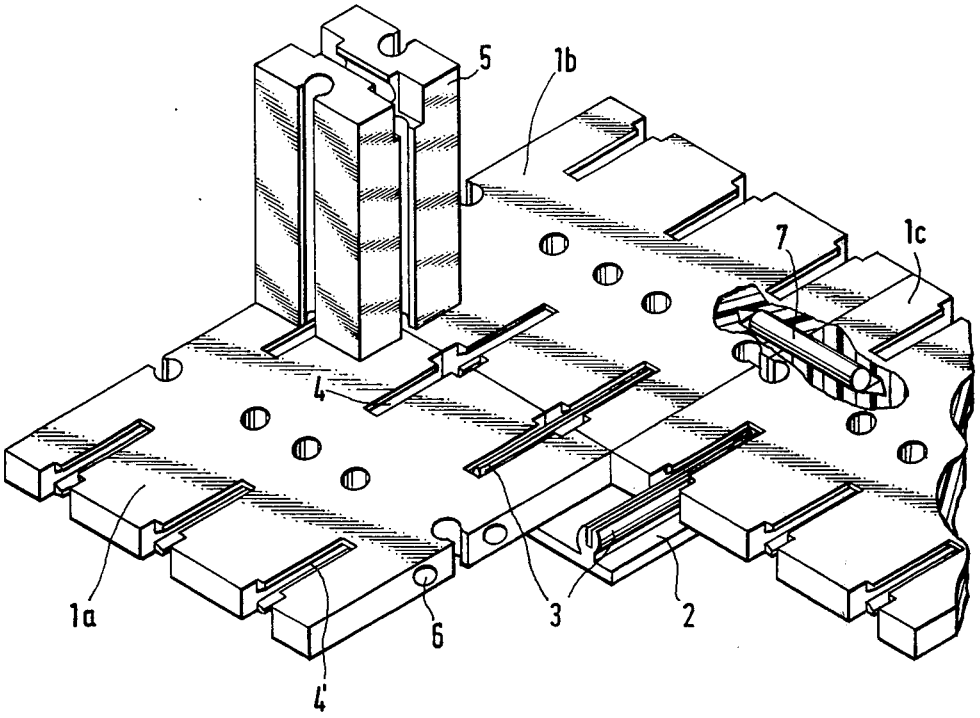
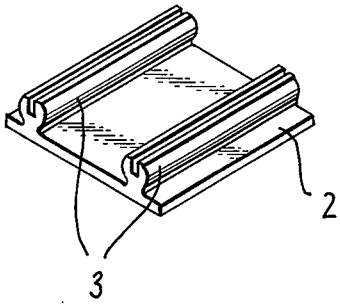
FIG. 2

COMPOSITE PLATE

BACKGROUND OF THE INVENTION

The present invention relates to an assembly kit, and more particularly to a large composite plate which is composed from several structural plates and connected with an additional structural element.

Assembly kits have been proposed in the art, in which several small structural plates are located adjacent to and connected with each other so as to form a large composite plate. For these purposes a connecting member has been proposed, which is formed as a cylindrical pin and inserted in the structural plates in the region of respective side margins thereof. Each of the structural plates of the known assembly kit is provided with a slot extending inwardly from a respective side margin thereof, which slot is used for mounting the structural element therein. The thus-formed structural plates and the connecting element do not give a possibility to provide a connection in the regions of the side margins of the structural plates, since the side margins must be free for insertion of the structural element into the slot formed in these side margins. This constitutes an essential disadvantage of the known assembly kits.

SUMMARY OF THE INVENTION

Accordingly, it is an object of the present invention to provide an assembly kit for assembling a large composite plate to which one or more structural elements are to be connected, which assembly kit avoids the disadvantages of the prior art assembly kits.

More particularly, it is an object of the present invention to provide an assembly kit for assembling a large composite plate and connecting a structural element therewith, which assembly kit gives a possibility to connect structural plates with each other in the regions of side margins of the latter.

In keeping with these objects, and with others, which will be come apparent hereinafter, one feature of the present invention, briefly stated, resides in a combination in an assembly kit of the type having a structural element provided with an undercut coupling projection, which combination comprises at least two structural plates adapted to be located adjacent to one another and each having two undercut slots one of which is parallel to the respective one slot of the other structural plate, and a plate-like connecting member provided with two elongated substantially parallel undercut projections each engageable with one of the slots of the respective structural plate. In such construction when the elongated undercut projections of the connecting member engage in the respective slots of the adjacent structural plates, the latter are assembled with one another so as to form a large composite plate. A structural element can be connected to the thus-formed large composite plate by insertion of the coupling projection thereof in a respective other slot of the structural plate.

Two further structural plates may be located adjacent to the first-mentioned two structural plates so that the slots of the latter are in alignment with the slots of the further structural plates. In this case one of the elongated undercut projections of the connecting member engages in the slot of one of the first-memtioned structural plates and simultaneously in the slot of one of the further structural plates, whereas the other elongated undercut projection of the connecting member engages in the slot of the other first-mentioned structural plate and in the slot of the other further structural plate. Thus, the above four plates are connected with each other by the same connecting member and together form the large composite plate. Since each of the structural plates has two slots, the undercut coupling projection of the structural element can engage at least the other slot of any of the thus-connected structural plates, which other slot is free from the elongated undercut projections of the connecting member. Thus, the structural element can be connected to any of the structural plates of the composite plate.

An additional cylindrical connecting member may be inserted in additional bores which are formed in the region of the side margins of the structural plates, so as to further improve the stability of the composite plate.

Each of the other slots of the structural plates may have a cross-section which is reduced in the direction from a lower surface of the structural plate to an upper surface thereof. The thus-constructed slots have an undercut form which is required for insertion of the undercut coupling projection of the structural element and engagement of the latter with the slots so as to position the structural element on the upper surface of the respective structural plate. The structural element may be moved along the respective slot to any place of the structural plate.

The connecting member may have a lower flat body part, and the elongated undercut projections thereof may be formed on an upper surface of the flat body part. In this case the elongated undercut projections of the connecting element engage the slots of the structural plates from below so that the upper surface of the structural plates is free for mounting of the structural element thereon.

At least the other slots of the structural plates each may have an enlarged portion which is open at the side margins of the structural plate. When the enlarged portion of the slot of one of the first-mentioned structural plates and the enlarged portion of the slot of one of the further structural plates are in alignment with one another, they together form a recess whose dimension corresponds to the largest dimension of the undercut coupling projection of the structural element. Such construction is particularly advantageous for the following reasons. When the first-mentioned structural plates are assembled with the further structural plates, their respective slots are in alighment with each other and are not open at the side margins, whereby the coupling undercut projection of the structural element cannot be inserted into the slots from the side margins. However, when the slots are constructed as described above, so that they have the enlarged portions which together form the recess corresponding to the largest dimension of the coupling undercut projection of the structural element, the latter can be inserted into the slots by insertion of the coupling undercut projection thereof in the thus-formed recess from above and then can be moved lengthwise of the respective slot to any desirable place of the structural plate.

Still a further feature of the present invention is that the elongated undercut projections of the connecting member each have a length exceeding the length of the individual slot. Such length is required in order to engage simultaneously the two aligned slots of the adjacent structural plates by the same one elongated projection of the connecting member. It is especially advantageous when the elongated undercut projections of the connecting member each have a length equal to twice the length of each slot. In this case, when the elongated undercut projection of the connecting member engages in the two aligned slots, it fully overlaps the entire length of the two slots and thereby the upper surface of the structural plates is completely closed.

Finally, an additional feature of the present invention is that the elongated undercut projections of the connecting member each has a height equal to substantially half of the height of the structural plate. When the above relation is maintained, the undercut coupling projection of the structural element can be inserted in the same slot of the structural plate, in spite of the fact that the elongated undercut projection of the connecting member is already inserted in the same slot.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a perspective view of an assembly kit in accordance with the present invention, including a composite plate assembled from several structural plates, and a structural element mounted on two of the structural plates; and FIG. 2 is a perspective view of a connecting member for connecting the structural plates with each other.

DESCRIPTION OF THE PREFERRED EMBODIMENT

As shown in FIG. 1, a large composite plate is assembled from individual structural plates 1*a*, 1*b*, and 1*c*. A connecting member 2 (shown in detail in FIG. 2) is provided, for connecting the structural plates with each other.

Each structural plate has at least two slots 4 which extend from a respective side margin of the structural plate inwardly of the latter. As shown in the drawing, six such slots are formed in each structural plate; however, it is understood that any desirable member of the slots may be formed in each individual structural plate, but not less than two. At least one slot of one of the structural plates, such as of the structural plate 1*b*, is substantially parallel to the slot of the other structural plate, such as of the structural plate 1*c*, for the reasons which will be explained hereinafter. The slots 4 each have a cross-section which is reduced in the direction from a lower surface of the structural plate towards an upper surface thereof so that the slots have the form of undercut slots.

A structural element 5 is provided, having an undercut projection adapted to engage in the undercut slots 4. Such undercut projections are well-known in the art and for these reasons are not shown in the drawing.

Each of the undercut slots 4 has an enlarged portion 4' which is open at the side margin of the respective structural plate. When the structural plates, such as the structural plates 1*a* and 1*b*, are located adjacent to one another so that the enlarged portions 4' of their slots 4 are in alignment with one another, the thus-aligned enlarged portions 4' together form a recess. The dimensions of the enlarged portions 4' are so selected that in the above aligned position the recess formed by the two enlarged portions 4' of the respective slots 4 has a dimension corresponding to the largest dimension of the undercut coupling projection of the structural element 5. In this case the structural element 5 can be mounted on the structural plate by insertion of the undercut coupling projection thereof into the above recess from the upper side of the composite structural plate. For the same purposes the enlarged portions 4' of the slots 4 extend over the entire thickness of the structural plate.

The connecting member 2 has a plate-like body part and two elongated undercut projections 3 which are substantially parallel to one another and each is engageable with one of the slots 4 of the respective structural plate. As mentioned above, at least one slot of one of the structural plates, such as the structural plate 1*b*, is parallel to at least one slot of the other structural plate, such as the structural plate 1*c*, and therefore the parallel elongated undercut projections 3 of the connecting member 2 can be simultaneously inserted in the slots of the structural plates 1*b* and 1*c* and thereby can connect the latter with each other.

The elongated undercut projections 3 of the connecting member 2 each has a length exceeding the length of each individual slot 4. This has the result that when the elongated undercut projections 3 are inserted in the slots 4 of the first pair of structural plates 1*b* and 1*c*, they overlap the length of these slots and also project outwardly beyond the side margins of the plates 1*b* and 1*c*. The two further plates, that is the structural plate 1*a* and a fourth plate which is not shown in the drawing, can be fitted over the thus-projecting portions of the elongated undercut projections 3 of the connecting member 2.

Preferably, the length of the elongated undercut projection 3 of the connecting member 2 is equal to twice the length of each individual slot 4. In this case, each elongated undercut projection 3 fully overlaps the length of the two slots 4 aligned with one another, such as the slots 4 of the structural plates 1*a* and 1*b*, so that the composite plate assembled from these structural plates has a closed (i.e., continuous) upper surface.

The elongated undercut projections 3 of the connecting member 2 each has a height which is substantially equal to half of the thickness of the structural plate. Such relation provides for insertion in the same slot of both the coupling undercut projection 3 of the coupling element 2, inasmuch as the elongated undercut projection 3 of the connecting member 2, will engage in a lower portion of the slot whereas the undercut coupling projection of the structural element 5 will engage in an upper portion of the same slot.

A cylindrical pin 7 is inserted in bores 6 provided in the marginal portions of the structural plates so as to further improve the stability of the connection of the structural plates with each other.

In the process of playing, a child successively fits the individual structural plates onto the elongated undercut projections 3 of the connecting member 2 so as to assemble the large composite plate. Then, he or she inserts the undercut coupling projection of the structural element 5 into the recess formed by the enlarged portions 4' of the slots 4 of the structural plates from the upper side of the latter, and moves the structural element 5 lengthwise of the respective slot 4.

The assembly kit which is constructed as described above gives a possibility to connect the structural plates with each other in the regions of the side margins of the structural plates. The structural element may be connected after assembling of the thus-formed composite plate, inasmuch as such connection does not require a free side margin.

It will be understood that each of the elements described above, or two or more together, may also find a useful application in other types of constructions differing from the types described above.

While the invention has been illustrated and described as embodied in a composite plate assembled of structural plates, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an assembly kit of the type having a structural element provided with an undercut coupling projection, a combination comprising at least two structural plates each having two undercut slots, said plates being adapted to be located adjacent to each other with at least one of said slots of each structural plate extending at least substantially parallel to a slot of the respective other structural plate; and a plate-like connecting member having two elongated substantially parallel undercut projections each engageable in one of said slots of the respective structural plate so that, when said elongated undercut projections engage in respective slots of said structural plates, the structural plates are assembled with one another so as to form a large composite plate, and the structural element can be connected to such composite plate by inserting the coupling projection thereof into a respective other one of said slots.

2. The combination as defined in claim 1, wherein each of said structural plates has two side margins spaced from one another, said slots extending from said side margins inwardly of said structural plate.

3. The combination as defined in claim 1, wherein each of said structural plates has an upper surface on which the structural element is to be positioned and a lower surface downwardly spaced from said upper surface, at least said other slots being of a cross-section which is reduced in the direction from said lower surface towards said upper surface of said structural plate.

4. The combination as defined in claim 1, wherein said connecting member has a substantially flat body part having an upper surface which faces towards said structural plates, said elongated undercut projections being formed on said upper surface of said body part of said connecting member.

5. The combination as defined in claim 1; and further comprising two further such structural plates adapted to be so located with respect to said first-mentioned plates that slots of the former are in alignment with slots of the latter, said elongated undercut projections of said connecting member each having a length exceeding the length of each of said slots so that said elongated undercut projections of said connecting element engage in the respective slots of both said first-mentioned and said further structural plates so as to connect the four structural plates with each other.

6. The combination as defined in claim 5, wherein each of said first-mentioned structural plates and said further structural plates has a side margin, the side margin of one of said first-mentioned structural plates being adjacent to the side margins of the respective further structural plate when they are assembled in the composite plate, at least each of said other slots having an enlarged portion which is open at the respective side margin and extends over the entire thickness of the respective structural plate, the enlarged portion of the slot of one of said first-mentioned structural plates and the enlarged portion of the respective one further structural plate adjacent to said one first-mentioned structural plate together forming a recess whose dimension corresponds to the largest dimension of said coupling undercut projection of the structural element.

7. The combination as defined in claim 6, wherein said length of each of said elongated undercut projections of said connecting member is substantially equal to twice the length of each of said slots of said structural plates.

8. The combination as defined in claim 7, wherein said elongated undercut projections of said connecting member each has a height substantially equal to half of the thickness of each of said structural plates.

* * * * *